US008747242B2

(12) United States Patent
Erario et al.

(10) Patent No.: US 8,747,242 B2
(45) Date of Patent: Jun. 10, 2014

(54) HANDHELD DISPLAY WITH GPS RECEIVER AND RF TRANSMITTER

(75) Inventors: Richard Erario, Wilton, CT (US); John Erario, Woodhaven, NY (US)

(73) Assignee: Accurate Technologies, Woodhaven, NY (US)

( * ) Notice: Subject to any disclaimer, the term of this patent is extended or adjusted under 35 U.S.C. 154(b) by 41 days.

(21) Appl. No.: 12/894,848

(22) Filed: Sep. 30, 2010

(65) Prior Publication Data

US 2011/0077094 A1 Mar. 31, 2011

Related U.S. Application Data

(60) Provisional application No. 61/247,219, filed on Sep. 30, 2009.

(51) Int. Cl.
*A63B 57/00* (2006.01)

(52) U.S. Cl.
USPC ..... 473/199; 473/407

(58) Field of Classification Search
USPC ..... 473/199, 407
IPC ..... A63B 2225/50,2220/12
See application file for complete search history.

(56) References Cited

U.S. PATENT DOCUMENTS

| | | | | |
|---|---|---|---|---|
| 6,768,450 | B1 | 7/2004 | Walters et al. | |
| 7,034,747 | B1 | 4/2006 | Walters et al. | |
| 7,095,312 | B2 | 8/2006 | Erario et al. | |
| 2005/0101415 | A1 * | 5/2005 | Sweeney | 473/407 |
| 2005/0227791 | A1 * | 10/2005 | McCreary et al. | 473/407 |
| 2008/0207357 | A1 * | 8/2008 | Savarese et al. | 473/407 |
| 2011/0074345 | A1 | 3/2011 | Erario et al. | |
| 2011/0077112 | A1 | 3/2011 | Erario et al. | |

* cited by examiner

*Primary Examiner* — William M. Brewster
(74) *Attorney, Agent, or Firm* — McCarter & English, LLP.

(57) ABSTRACT

A handheld display device is provided with a screen, a user interface, and electronics for enabling wireless communications. The handheld device is adapted for wirelessly receiving GPS tracking data from a satellite tracking system, wirelessly receiving transmitted RF data from electronically equipped sports objects, and/or wirelessly transmitting RF data to a computer controlled network. The system is also capable of on-board analysis of obtained data.

9 Claims, 1 Drawing Sheet

HANDHELD DISPLAY WITH GPS RECEIVER AND RF TRANSMITTER

BACKGROUND OF THE INVENTION

1. Field of the Invention

The invention relates to a handheld device for wirelessly tracking, for example, a GPS equipped sports object as well as analyzing, receiving, transmitting received data, and storing data.

2. Background of the Related Art

The use of GPS in various implementations has proliferated over recent years. U.S. Pat. No. 6,768,450, to Walters, et al., granted on Jul. 27, 2004, and its child, U.S. Pat. No. 7,034,747, granted on Apr. 25, 2006, both disclose a "System And Method For Wirelessly Linking A GPS Device And A Portable Electronic Device" and both are incorporated herein by reference. The inventions therein, assigned to Garmin Ltd., are directed to wirelessly linking a GPS device with portable electronics device so as to provide the second device with GPS functions.

Applying GPS to sporting objects has also been investigated in the art. U.S. Pat. No. 7,095,312, to Erario et al., granted on Aug. 22, 2006, discloses a "System And Method For Tracking Identity Movement And Location Of Sports Objects" (the "'312 patent") and is incorporated herein by reference. This patent discloses embedding electronics within a sports object, such as a golf ball, so that the ball is capable of utilizing GPS technology to communicate its position, using RF technology, with an RF receiver array. The array communicates with a system server, which may be a PC.

In view of the above disclosed prior art, what is needed is a handheld display device designed with the capability to both receive RF transmissions from a user-selected sporting object, such as a ball equipped with GPS enabling technology, as well as to display flight characteristics of the sports objects on a display screen.

SUMMARY OF THE DISCLOSURE

A handheld display device is provided with a screen, a user interface, and electronics for enabling wireless communications. The handheld device is adapted for wirelessly receiving GPS tracking data from a satellite tracking system, wirelessly receiving transmitted RF data from electronically equipped sports objects, and/or wirelessly transmitting RF data to a computer controlled network. The system is also capable of on-board analysis of obtained data.

BRIEF DESCRIPTION OF THE FIGURES

In order that the manner in which the above recited objectives are realized, a particular description of the invention will be rendered by reference to specific embodiments thereof that are illustrated in the appended drawings. Understanding that the drawings depict only typical embodiments of the invention and are not therefore to be considered to be limiting of its scope, the invention will be described and explained with additional specificity and detail through the use of the accompanying drawings in which.

DESCRIPTION OF THE DISCLOSED EMBODIMENTS

The present invention provides a handheld display device 10 (FIG. 1) designed with the capability to both receive RF transmissions from user-selected Smaart™ enabled sports objects and display flight characteristics of the sports objects on a display screen.

In one embodiment, the user selects a number and/or type of Smaart™ enabled sports object (not shown) for use. For example, the user can select Smaart™ golf balls. Along with the sport balls, the user would select the Smaart™ enabled handheld device 10.

With the handheld device 10, the user begins a round of play. For example, the user plays a round of golf at a golf course. During this time, the user carries the handheld device 10 throughout the course.

For each stroke played throughout the course, the positional data is transmitted from the ball to the handheld device 10. This positional data can be transmitted as a real-time data stream. Alternatively, the positional data can be transmitted as a post-flight data stream.

If post-flight data is transmitted, the handheld device 10 would serve as a data storage device for at least the time period between when data is received by the handheld device 10 and when data is subsequently retransmitted from the handheld device 10. Using the handheld device 10 as a storage device is an alternative to using a personal computer as a storage device, which is taught in the above referenced '312 patent.

The data received by the handheld device 10 can be displayed during or after each event. For example, as indicated, the data can also be stored as a file within the handheld device 10 for viewing at a later time. Moreover, the data can be exported from the handheld device 10, into a Smaart™ enabled video gaming environment. Other uses would be apparent to one skilled in the art upon reading the present disclosure.

The present invention also includes technology for providing the handheld device 10 with useful attributes. Such attributes include electronics (hardware and software, as required) so that the handheld device 10 is capable of performing one or more of the following functions: operating as a GPS receiver; uploading and displaying course layouts; importing, for later viewing, a golfer's historical data; uploading and saving, for later viewing, positional data; exporting saved positional data for use as a training aid; and many other suitable functions.

It is to be appreciated that the handheld device 10 may be adapted and utilized in many other sporting events. In such events, the handheld device 10 would be capable of capturing, displaying, manipulating and storing positional data in a similar manner as disclosed herein.

Moreover, it may be desirable to use the handheld device 10 with Smaart™ tracking features at locations unequipped with smaart tracking technology. Those locations include, for example, a golf course or other sporting field. In an open field, the system could be utilized for private entertainment.

Figure 1:
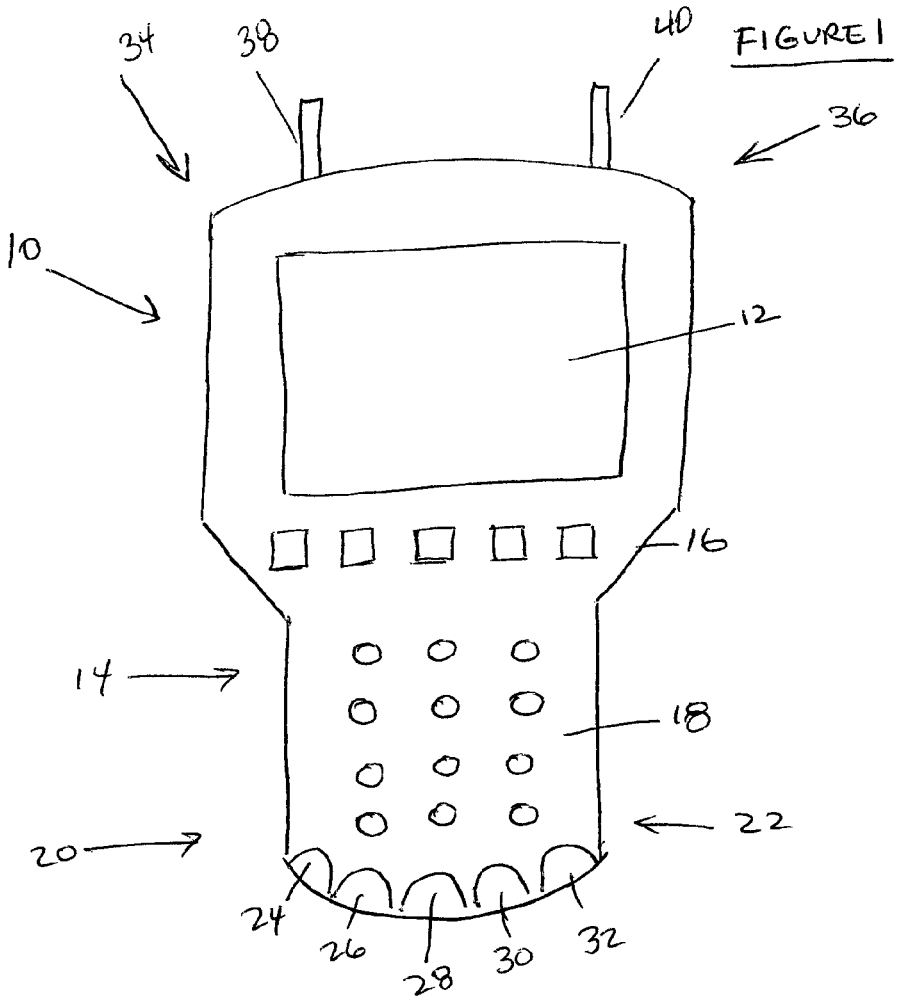
FIG. 1 is a front view of an embodiment of the invention.

Turning to FIG. 1, the handheld device 10 includes a screen 12 displaying a graphical user interface (GUI). The screen is illustrated as having a square viewing area, such as found in a BlackBerry™ smartphone. However other shapes could be provided.

The system also includes a keypad 14 which includes an upper keypad 16 and a lower keypad 18. The upper keypad 16 is illustrated as including five function keys 16. However, the system is not limited to five function keys as either a minimum or a maximum. The function keys 16 can be preprogrammed or be programmable by the user. The lower keypad 16 is illustrated as being provided in a telephone keypad form. However, a QWERTY keypad could be provided.

Together, the screen 12 and keypad 14 provide a user with the ability to selectively control all user accessible features of the handheld device 10. A technician could also use the screen 12 and keypad 14 to perform diagnostics on the system. Furthermore, the screen 12 could be a touch screen which could obviate the requirement for an actual keypad 14. In an alternative embodiment, it is also within the scope of this invention that the handheld device could be equipped with voice recognition technology to allow the user to input data.

A bottom 20 of the handheld device 10 is illustrated as including plural ports 22. The ports include a program port 24, a charging port 26, a video port 28, a USB port 30 for network/Internet access and a Bluetooth connector port 32. The plural ports 22 need not be located at the bottom 20, and need not be clustered together.

Other port types serving the same or different purpose can be utilized. For example, while USB has been identified for enabling network access, other port types can be used for accessing a LAN, WAN and/or PAN (local, wide and personal area networks).

Rather than plural different ports, plural ports of the same type may be provided. This is to enable simultaneous use of plural services which utilized the same port type. For example, USB can be utilized for various services, from printing to data transfer to network access. Accordingly, plural USB ports may be provided to give the handheld device 10 additional flexibility. Alternatively, a grouping of similar and dissimilar ports may be provided.

Furthermore, when services are provided based on internal electronics, one or more of the ports may be omitted. For example, it has become customary to provide smartphones with on-board wireless Internet and Bluetooth access. External ports for such services would be unnecessary.

A top 34 of the handheld device 10 includes plural antennas 36, including, e.g., a first antenna 38 and a second antenna 40. The antennas 36 enable unidirectional and/or bi-directional communications as would be appreciated by one reading the disclosure. Such communications would be between electronics within the handheld device 10 and, for example, GPS satellites, reference receivers, Smaart™ objects, mesh networks, system servers and the like.

The antennas 36 need not be external. While two antenna 38, 40 are illustrated, the system could be equipped with a greater or lesser number of antennas. Such antenna usage will be understood by one of ordinary skill assembling the technologies within the handheld device 10.

Figure 2:
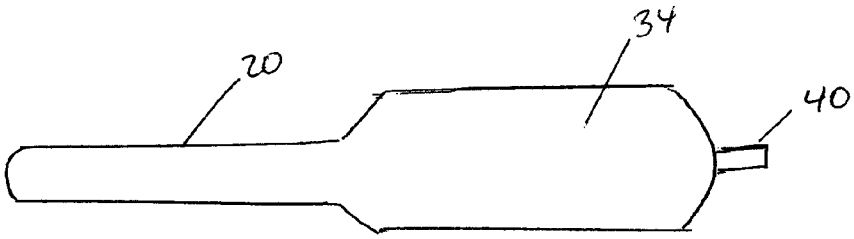
FIG. 2 is a side view of the embodiment illustrated in FIG. 1.

Turning to FIG. 2, a side view of the handheld device 10 is illustrated. The bottom 20 and top sections 34 of the device 10 are depicted such that the bottom 20 is narrower than the top section 34. The difference in thicknesses enables the top section 34 of the handheld device 10 to house one or more microprocessors and other electronics for uploading and downloading data and performing the other mentioned functions. However, this design is not limiting as the electronics can be distributed throughout the handheld device 10 and/or located in the bottom section 20 as may be desired.

In use, the handheld device is adapted for wirelessly receiving GPS tracking data from a satellite tracking system as well as wirelessly receiving transmitted RF data from electronically equipped sports objects. The internal electronics enable the system to wirelessly track and display flight characteristics of the moving sports object, which is embedded with its own GPS and microprocessor components. The handheld device 10 is adapted for displaying the tracking data in real-time and/or storing data for later use. Furthermore, the handheld device 10 is adapted for comparing data, received and/or stored within its memory, with data from one or more other played games.

Although the handheld device 10 has the capability of being self-contained with all necessary software and processing capabilities, it is within the scope of the invention for the handheld device 10 to be capable of wirelessly transmitting RF data to a computer controlled network. To facilitate such an application of the handheld device 10, the user can engage software for controlling internal electronics which instruct the handheld device 10 to upload to and/or download data from the network.

It is also within the scope of the invention to equip the handheld device 10 with capabilities which can be utilized outside of a sporting event. For example, the handheld device 10 can be adapted for storing maps of geographic areas and/or locations representing points of interest.

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

We claim:

1. A handheld display device comprising a screen with a user interface, and electronics for enabling wireless communications; said handheld device being adapted for:

wirelessly receiving GPS tracking data transmitted from one or more user selected electronically equipped sports objects and a satellite tracking system;

wirelessly receiving RF data transmitted from the one or more user selected electronically equipped sports objects, and receiving positional data transmitted from the one or more sports objects to the handheld device via a real-time data stream for multiple tracking while the one or more sports objects are in play; and storing data in the handheld device from the electronically equipped sports object where the handheld includes a processor, and is self-contained such that all necessary software and processing capabilities are in the handheld device without the need to utilize any external sensors, receivers, servers, and processors outside the one or more sports objects;

tracking the one or more sports objects at locations unequipped with tracking technology; and providing on-board analysis in the handheld device of data obtained.

2. The handheld device of claim 1, adapted for wirelessly tracking and displaying flight characteristics of a moving one or more user selected electronically equipped sports object embedded with GPS and microprocessor components.

3. The handheld device of claim 2, adapted for displaying said tracking data in real-time.

4. The handheld device of claim 2, adapted for transmitting wirelessly received tracking data to a computer controlled system server.

5. The handheld device of claim 2, adapted for storing said wirelessly received tracking data for later use.

6. The handheld device of claim 1, adapted for storing maps of geographic areas and locations points of interest.

7. The handheld device of claim 1, wherein said user interface is adapted for being manipulated by a user for instructing said handheld to upload and download data.

8. The handheld device of claim 7, adapted for comparing data, stored in said handheld device, representing plural played games.

9. The handheld device of claim 1, further adapted to export data into a video gaming environment.

* * * * *